United States Patent [19]

Zander et al.

[11] 4,379,133

[45] Apr. 5, 1983

[54] PROCESS FOR ANISOTROPIC CARBON PRODUCTION

[75] Inventors: Maximilian Zander, Castrop-Rauxel; Gerd-Peter Blümer, Datteln; Gerd Collin, Duisburg; Herbert Glaser, Gladbeck; Rolf Marrett, Castrop-Rauxel, all of Fed. Rep. of Germany

[73] Assignee: Rutgerswerke Aktiengesellschaft, Frankfurt am Main, Fed. Rep. of Germany

[21] Appl. No.: 275,290

[22] Filed: Jun. 19, 1981

[30] Foreign Application Priority Data

Jun. 26, 1980 [DE] Fed. Rep. of Germany ..... 3024423

[51] Int. Cl.[3] ..... C01B 31/00; C09C 1/48; C10G 21/18

[52] U.S. Cl. ..... 423/445; 208/40; 208/44; 208/45; 208/330; 423/447.4; 423/449

[58] Field of Search ..... 208/40, 44, 45, 330; 423/445, 447.4, 448, 449

[56] References Cited

U.S. PATENT DOCUMENTS

| | | | |
|---|---|---|---|
| 1,276,219 | 8/1918 | Holmes | 208/330 |
| 2,029,288 | 2/1936 | Bray | 208/44 |
| 2,605,222 | 7/1952 | Jones | 208/44 |
| 2,941,017 | 6/1960 | Veatch et al. | 208/330 |
| 2,941,019 | 6/1960 | Foreman et al. | 208/330 |
| 2,992,935 | 7/1961 | Winslow | 208/44 |
| 3,004,915 | 10/1961 | Kant | 208/330 |
| 3,997,654 | 12/1976 | Köllin et al. | 423/449 |
| 4,016,247 | 4/1977 | Otani et al. | 423/448 |
| 4,184,942 | 6/1980 | Angier et al. | 423/449 |
| 4,276,246 | 6/1981 | Bonzom et al. | 423/449 |

FOREIGN PATENT DOCUMENTS

| | | | |
|---|---|---|---|
| 130343 | 11/1948 | Australia | 208/44 |
| 440311 | 12/1935 | United Kingdom | 208/44 |

*Primary Examiner*—Gary P. Straub

*Attorney, Agent, or Firm*—Hammond & Littell, Weissenberger and Muserlian

[57] ABSTRACT

An improved process for treating coal tar pitch to form anisotropic carbon comprising treating coal tar pitch with picric acid, recovering the resulting picrates, decomposing the picrates and heating the resulting aromatic hydrocarbons to obtain anisotropic carbon in less time.

2 Claims, No Drawings

PROCESS FOR ANISOTROPIC CARBON PRODUCTION

STATE OF THE ART

Industrial anisotropic carbon plays an important role in the metallurgical industry to produce metal products with special properties and standard coal tar pitch which is the distillation residue of the industrial distillation of high-temperature coal tar pitch has been frequently suggested as a starting material for anisotropic carbon. The known methods of obtaining fractions of coal tar pitch for carbonization require the use of organic solvents, catalysts such as aluminum chloride, additives such as sulfur or specific temperatures and/or reaction periods and/or pressures in the carbonization process, each of which has their disadvantages.

These methods have been suggested individually and in various combinations with each other and they yield products which can then be carbonized into anisotropic carbon by subjecting the products to a heat treatment between 450° and 500° C. for several hours. The slow carbonization process has been considered to be absolutely necessary as it was believed that only with a very long reaction period in a turbulence-free reaction medium was it possible to form highly oriented carbons. This is taught, for example, by Huettinger [Bitumen, Teere, Asphalte, Peche, Vol. 24 (1973), p. 255–262]. The duration of the said process, apart from economical considerations, is not disadvantageous for most uses of anisotropic carbon. However, for the production of carbon fibers from pitch, for example, attempts have been made to find a process for the treatment of pitch fractions where the transformation to anisotropic carbon is effected rapidly.

OBJECTS OF THE INVENTION

It is an object of the invention to provide an improved process for the conversion of coal tar pitch fractions into anisotropic carbon rapidly and in substantially quantitative yields at a relatively low temperature.

This and other objects and advantages of the invention will become obvious from the following detailed description.

THE INVENTION

The novel process of the invention for the production of anisotropic carbon comprises treating coal tar pitch with picric acid to form picrates, recovering the picrates, decomposing the picrates and heating the resulting coal tar pitch fraction to transform it into anisotropic carbon.

The possible fractionation of standard coal tar pitch by using picric acid as a charge transfer-sequestering agent is described in the literature as an analytical method by Bluemer et al (Compendium 77/78, Supplement to the Journal of Erdoel und Kohle-Erdgas-Petrochemie, p. 235–251). However, it has now been found that the coal tar pitch fractions obtained from picric acid complexes can surprisingly be carbonized very rapidly to form highly anisotropic carbon, i.e. about 10 times faster than a filtered coal tar pitch fraction.

The picric acid complexes are preferably prepared by extracting coal tar pitch with a suitable organic solvent such as toluene or xylene, treating the resulting extract solution with picric acid, preferably dissolved in the same organic solvent, whereby the resulting picrates precipitate out of solution and are recovered by any convenient method such as filtration. The picrates are then treated with an aqueous base such as ammonium hydroxide to decompose the picrate and the aromatic hydrocarbon or coal tar pitch fraction is recovered.

The resulting coal tar pitch fractions due to their greater reactivity can be carbonized into anisotropic carbon by heating at 350° to 550° C. at pressures of 0.1 to 50 bar for a short period of time such as 100 to 30 minutes in contrast to the longer reaction periods of several hours of the prior art.

In the following examples there are described several preferred embodiments to illustrate the invention. However, it should be understood that the invention is not intended to be limited to the specific embodiments.

EXAMPLE 1

100 g of coal tar pitch with a softening point of 72° C. as determined by the Kraemer-Sarnow method were extracted with stirring for 15 minutes with 5 liters of refluxing toluene and the organic solution was cooled to room temperature and was filtered to remove 19.9 g of insoluble matter. 0.5 liters of toluene were added to the filtrate at room temperature and a solution of 4 g of picric acid in 125 ml of toluene was added thereto. A picrate began to precipitate out immediately and the mixture was stirred for 30 minutes and was then filtered. The recovered product was washed with toluene and dried to obtain 11.7 g of picrate which were then suspended in 625 ml of chloroform. The resulting suspension was treated at room temperature with 15% aqueous ammonium hydroxide solution to dissolve the aromatic hydrocarbon fraction and the organic solution was washed with water to remove the ammonium picrate formed and was evaporated to dryness.

The 9.8 g of residue which had a softening point of 190° C. as determined by the Kraemer-Sarnow method was heated in an autoclave for 70 minutes at 425° C. and a pressure of 10 bar resulting in a quantitative yield of carbon. The anisotropy of the carbon was evaluated by examination of microsections under a polarization microscope customarily used for carbon anisotropy evaluation and the carbon of this example showed large, undisturbed anisotropic structures.

COMPARISON EXAMPLE

Filtered coal tar pitch with a softening point of 70° C. as determined by the Kraemer-Sarnow method and a quinoline-insoluble content of 0.35% was heated in an autoclave at 425° C. at a pressure of 10 bar for a reaction period of 13 hours which was required for a complete transformation into anisotropic carbon.

Various modifications of the process of the invention may be made without departing from the spirit or scope thereof and it is to be understood that the invention is intended to be limited only as defined in the appended claims.

What we claim is:

1. A process for the preparation of anistropic carbon comprising extracting coal tar pitch with an organic solvent, adding picric acid to the extract solution to form picrates, recovering the picrates, decomposing the picrates and heating the resulting coal tar pitch fraction at 350° to 550° C. at a pressure of 0.1 to 50 bar for about 100 to 30 minutes to transform it substantially quantitatively into anisotropic carbon and recovering the anisotropic carbon formed at 350° to 550° C.

2. The process of claim 1 wherein the recovered picrates are decomposed by treatment with an aqueous base.

* * * * *